US009713234B2

(12) United States Patent
Gotoh et al.

(10) Patent No.: US 9,713,234 B2
(45) Date of Patent: Jul. 18, 2017

(54) LIGHTING FIXTURE, LIGHTING SYSTEM, AND METHOD PERFORMED BY THE LIGHTING FIXTURE

(71) Applicant: Panasonic Intellectual Property Management Co., Ltd., Osaka (JP)

(72) Inventors: Shigeo Gotoh, Osaka (JP); Atsuo Nanahara, Kyoto (JP); Shinsuke Nishioka, Osaka (JP); Tamotsu Ando, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/080,451

(22) Filed: Mar. 24, 2016

(65) Prior Publication Data

US 2016/0302288 A1 Oct. 13, 2016

(30) Foreign Application Priority Data

Apr. 10, 2015 (JP) ..... 2015-081200

(51) Int. Cl.
*H05B 37/02* (2006.01)

(52) U.S. Cl.
CPC ..... *H05B 37/0272* (2013.01)

(58) Field of Classification Search
CPC .. H05B 37/02; H05B 37/0272; H05B 37/029; H05B 37/0245; H05B 33/0863; H05B 33/0845; H05B 33/08; H05B 33/084
USPC ..... 315/149, 291, 292, 307, 308; 700/90, 700/275, 295, 296, 297
See application file for complete search history.

(56) References Cited

U.S. PATENT DOCUMENTS

| | | | | |
|---|---|---|---|---|
| 7,583,901 | B2 | 9/2009 | Nakagawa et al. | |
| 7,929,867 | B2 | 4/2011 | Nakagawa | |
| 2002/0065583 | A1* | 5/2002 | Okada | H04B 3/54 700/295 |
| 2006/0056855 | A1* | 3/2006 | Nakagawa | G09F 9/33 398/183 |
| 2006/0125426 | A1* | 6/2006 | Veskovic | H05B 37/0254 315/312 |

(Continued)

FOREIGN PATENT DOCUMENTS

| | | | |
|---|---|---|---|
| JP | 2004-297295 | A | 10/2004 |
| JP | 2011-192548 | A | 9/2011 |

(Continued)

*Primary Examiner* — Thai Pham
(74) *Attorney, Agent, or Firm* — McDermott Will & Emery LLP

(57) ABSTRACT

A lighting fixture includes a transceiver, a receiver, a storage, and a controller. The transceiver receives a radio command from a radio remote controller for operating the lighting fixture. The receiver receives an infrared command from an infrared remote controller for operating the lighting fixture. The storage stores identification information of the radio remote controller. The controller, if the identification information is stored in the storage, accepts a radio command that includes identification information same as the identification information stored in the storage, among radio commands received by the transceiver, and ignores the infrared command received by the receiver, and if no identification information is stored in the storage, accepts the infrared command received by the receiver.

8 Claims, 11 Drawing Sheets

(56) References Cited

U.S. PATENT DOCUMENTS

| | | | | |
|---|---|---|---|---|
| 2008/0074872 | A1* | 3/2008 | Panotopoulos .... | H05B 33/0869<br>362/231 |
| 2009/0297156 | A1 | 12/2009 | Nakagawa et al. | |
| 2009/0297157 | A1 | 12/2009 | Nakagawa | |
| 2009/0297166 | A1 | 12/2009 | Nakagawa et al. | |
| 2009/0297167 | A1 | 12/2009 | Nakagawa et al. | |
| 2009/0310976 | A1 | 12/2009 | Nakagawa et al. | |
| 2011/0285515 | A1* | 11/2011 | Fushimi ..... | H05B 37/0272<br>340/12.22 |
| 2015/0280824 | A1* | 10/2015 | Hong ..... | H01L 25/167<br>398/118 |

FOREIGN PATENT DOCUMENTS

| | | | |
|---|---|---|---|
| JP | 2012-089276 | A | 5/2012 |
| JP | 2014-022197 | A | 2/2014 |
| JP | 2014-236309 | A | 12/2014 |

* cited by examiner

LIGHTING FIXTURE, LIGHTING SYSTEM, AND METHOD PERFORMED BY THE LIGHTING FIXTURE

CROSS REFERENCE TO RELATED APPLICATION

This application claims the benefit of priority of Japanese Patent Application Number 2015-081200, filed Apr. 10, 2015, the entire content of which is hereby incorporated by reference.

BACKGROUND

1. Technical Field

The present disclosure relates to a lighting fixture, a lighting system which includes a plurality of the lighting fixtures and a radio remote controller, and a method performed by the lighting fixture.

2. Description of the Related Art

For example, Japanese Unexamined Patent Application Publication No. 2012-89276 (PTL 1) discloses a lighting control apparatus which includes a plurality of lighting fixtures each identified by an ID (identification information) and having capabilities of receiving radio waves, and a radio remote controller which has capabilities of transmitting radio waves. In the lighting control apparatus disclosed in PTL 1, a communication partner is set an ID and configured to be paired with the radio remote controller. Specifically, in the lighting control apparatus disclosed in PTL 1, a specific radio remote controller sets an ID to and pair with a specific lighting fixture, and reception sensitivity of the specific lighting fixture is reduced to prevent an unknown radio remote controller surrounding the lighting control apparatus from setting an ID to the specific lighting fixture, and a lamp included in the specific lighting fixture is lit off to reduce effects of noise caused by the lamp light. As such, the lighting control apparatus disclosed in PTL 1 prevents a surrounding unknown radio remote controller from setting an ID to a lighting fixture, and, furthermore, reduces noise from the lamp.

Japanese Unexamined Patent Application Publication No. 2011-192548 (PTL 2) discloses an adjustor for a lighting fixture, which adjusts a direction of light emission by a lighting unit that is configured to emit light and supported by a support member in a manner pivotable in a pan direction and tilt direction, wherein the adjustor drives the support member based on a radio signal, and changes a frequency of the radio signal using an infrared signal.

SUMMARY

However, a problem with PTL 1 is that a lighting fixture that is not paired with the lighting control apparatus is uncontrollable. For example, power supply to the lighting fixtures not being paired can be turned on and off via a wall switch, but the lighting fixtures not being paired cannot be controlled individually because the wall switch collectively handles the lighting fixtures.

The adjustor disclosed by PTL 2 is also unable to control a lighting fixture if the lighting fixture has not been through frequency allocation of the radio signal, where the frequency allocation to the lighting fixture is regarded as pairing the lighting fixture with the adjustor.

An object of the present disclosure is to provide a lighting fixture, a lighting system, and a method performed by the lighting fixture, which allow readily controlling of both a paired lighting fixture and a non-paired lighting fixture.

In order to achieve the above object, one aspect of a lighting fixture according to the present disclosure is a lighting fixture which receives a radio command from a radio remote controller for operating the lighting fixture, and an infrared command from an infrared remote controller for operating the lighting fixture, the lighting fixture including: a transceiver which receives the radio command; a receiver which receives the infrared command; a storage for storing identification information of the radio remote controller; and a controller which if the identification information is stored in the storage, accepts a radio command that includes identification information same as the identification information stored in the storage, among radio commands received by the transceiver, and ignores the infrared command received by the receiver, and if no identification information is stored in the storage, accepts the infrared command received by the receiver.

One aspect of a lighting system according to the present disclosure includes lighting fixtures which receive a radio command from a radio remote controller for operating the lighting fixtures, and an infrared command from an infrared remote controller for operating the lighting fixtures; the radio remote controller configured to operate in a pairing configuration mode in which the radio remote controller transmits, repeatedly for a predetermined time period, a pairing command which includes identification information of the radio remote controller, and a normal operation mode in which the radio remote controller transmits the radio commands; and the infrared remote controller which transmits the infrared command to at least one of the lighting fixtures, wherein the lighting fixtures each include: a transceiver which receives the radio command; a receiver which receives the infrared command; a storage for storing the identification information of the radio remote controller; and a controller which if the identification information is stored in the storage, accepts a radio command that includes identification information same as the identification information stored in the storage, among radio commands received by the transceiver, and ignores the infrared command received by the receiver, and if no identification information is stored in the storage, accepts the infrared command received by the receiver.

One aspect of a method according to the present disclosure is a method performed by a lighting fixture which receives a radio command from a radio remote controller for operating the lighting fixture, and an infrared command from an infrared remote controller for operating the lighting fixture, the method including: receiving the radio command; receiving the infrared command; determining whether identification information of the radio remote controller is stored in a storage included in the lighting fixture; if the identification information is stored in the storage, among radio commands received, accepting a radio command that includes identification information same as the identification information stored in the storage and ignoring a radio command that includes identification information different from the identification information stored in the storage, and ignoring the infrared command; and if no identification information is stored in the storage, accepting the infrared command received.

According to the lighting fixture, the lighting system, and the method performed by the lighting fixture of the present disclosure, in the lighting system which includes the lighting fixtures and a radio remote controller, both a paired lighting fixture and a non-paired lighting fixture are readily controllable.

BRIEF DESCRIPTION OF DRAWINGS

The figures depict one or more implementations in accordance with the present teaching, by way of examples only, not by way of limitations. In the figures, like reference numerals refer to the same or similar elements.

FIG. 8 is a flowchart illustrating an example of processing performed by the lighting fixture according to Embodiment 1 at power on;

FIG. 10 is a flowchart illustrating an example of processing performed by a lighting fixture according to Embodiment 2 at power on.

DETAILED DESCRIPTION OF THE EMBODIMENTS

Hereinafter, embodiments according to the present disclosure are described, with reference to the accompanying drawings. It should be noted that the embodiments described below are each merely one embodiment of the present disclosure. Values, shapes, materials, components, and arrangement and connection between the components, steps and the order of steps, etc., indicated in the following embodiments are merely illustrative and not intended to limit the present disclosure. Moreover, among the components of the embodiments below, components not recited in any one of the independent claims defining the most generic part of the present disclosure are described as arbitrary components of an embodiment. The figures are schematic views and do not necessarily illustrate the exact dimensions of the components.

Embodiment 1

A lighting system according to the present embodiment is to be described, with reference to the accompanying drawings.

[1.1 Configuration Example of Lighting System]

Figure 1:
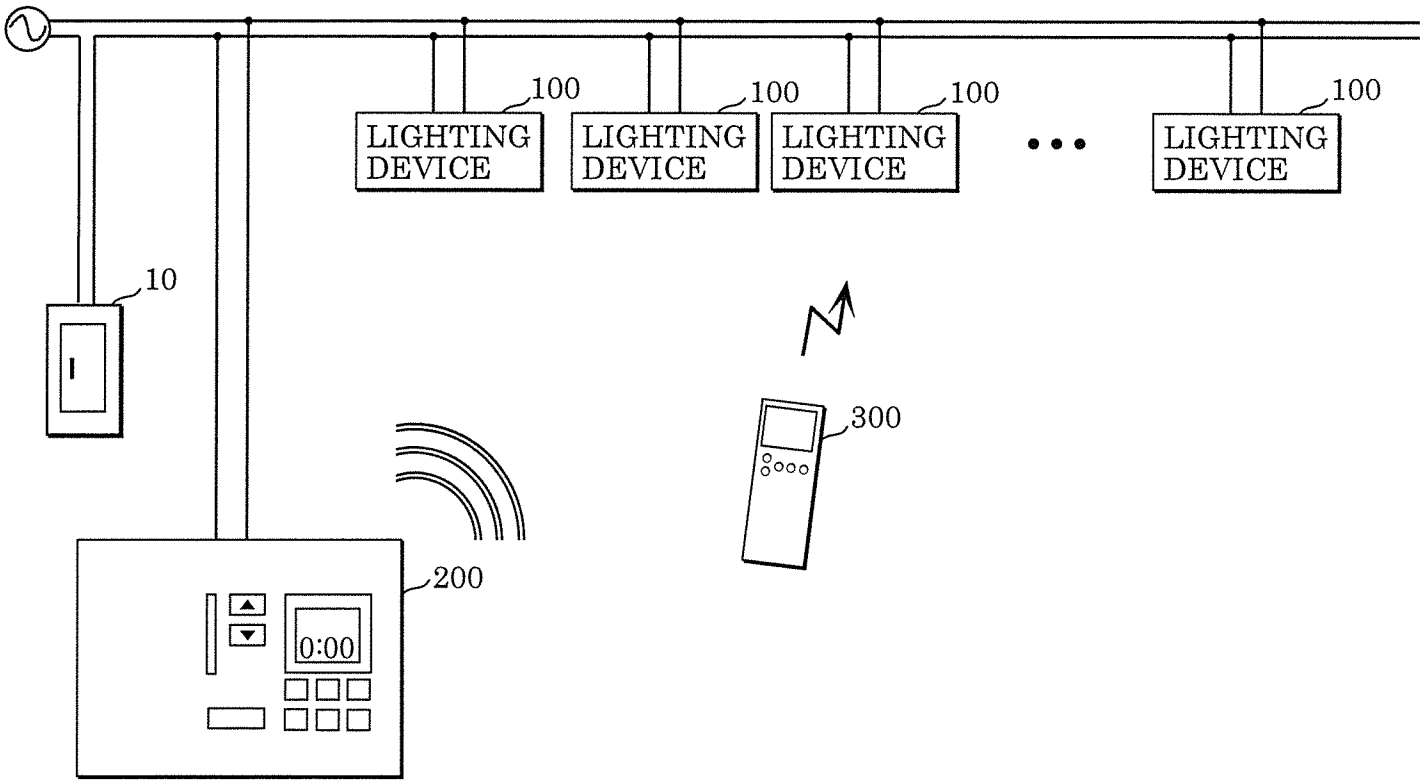
FIG. 1 is a block diagram of a configuration example of a lighting system according to Embodiment 1.

FIG. 1 is a block diagram of a configuration example of the lighting system according to Embodiment 1. The lighting system in the figure includes switch 10, a plurality of lighting fixtures 100, radio remote controller 200, and infrared remote controller 300.

Switch 10 is what is known as a wall switch which switches between conduction and non-conduction of alternating current power lines to which the plurality of lighting fixtures 100 are connected. While one switch 10 is shown in the figure, the lighting system according to Embodiment 1 includes one switch 10 per five lighting fixtures 100, for example.

The plurality of lighting fixtures 100 are controlled to be turned on and off by switch 10, and are also controlled by radio remote controller 200 and infrared remote controller 300. Specifically, if lighting fixture 100 is storing identification information of radio remote controller 200 serving as a master device (i.e., if lighting fixture 100 is paired with radio remote controller 200 and is not in initial state 2 described below), lighting fixture 100 accepts a radio command which includes the identification information, and ignores an infrared command transmitted from infrared remote controller 300. However, lighting fixture 100, even when paired with radio remote controller 200, accepts an unpairing signal that is transmitted from infrared remote controller 300. If lighting fixture 100 is not storing the identification information of the master device (i.e., if lighting fixture 100 is not paired with radio remote controller 200 and is in initial state 2), lighting fixture 100 accepts an infrared command transmitted from infrared remote controller 300. This allows both paired lighting fixture 100 and non-paired lighting fixture 100 to be readily controlled in the lighting system which includes the plurality of lighting fixtures 100 and radio remote controller 200. Specifically, lighting fixture 100 not paired with radio remote controller 200 is controllable by infrared remote controller 300.

For example, if there is lighting fixture 100 that is not paired with radio remote controller 200 at installation of the lighting system, that lighting fixture 100 is uncontrollable by radio remote controller 200, but infrared remote controller 300 can control that lighting fixture 100 such that lighting fixture 100 emits light and stops emitting light. For example, in the case where a corner of a room where the lighting system is installed is laid out as a meeting area, among the plurality of lighting fixtures 100, lighting fixtures 100 corresponding to the meeting area are controllable by infrared remote controller 300 once they are unpaired and released from control by radio remote controller 200, such that they emit light when a meeting is held, and stop emitting the light when the meeting ends.

As described above, in order for radio remote controller 200 to control lighting fixture 100, radio remote controller 200 and lighting fixture 100 need to be paired with each other. The paired state may be a state in which at least lighting fixture 100 is storing the identification information of radio remote controller 200 serving as the master device. This associates lighting fixture 100 with radio remote controller 200 serving as the master device. Examples of the above identification information include an address of radio remote controller 200. Lighting fixture 100 paired with radio remote controller 200 operates according to a radio command which includes the identification information of the master device. Lighting fixture 100 not paired with radio remote controller 200 ignores the radio command since lighting fixture 100 does not know its master device. It should be noted that while the paired state may be the state in which at least lighting fixture 100 is storing the identification information of the master device, the paired state may further include a state in which radio remote controller 200 is storing identification information or model information of lighting fixture 100, for example.

If lighting fixture 100 is in an initial state at power on, lighting fixture 100 operates in a pairing configuration mode for storing the identification information of radio remote controller 200 serving as the master device. In the present embodiment, there are two types of pairing configuration modes, a simple configuration mode and a manual configuration mode. Lighting fixture 100 enters the simple configuration mode if lighting fixture 100 is in initial state 1 at power on. Lighting fixture 100 enters the manual configuration mode if lighting fixture 100 is in initial state 2 at power on.

Initial state 1 refers to a state in which lighting fixture 100 is at factory default settings. Specifically, initial state 1 is a state in which lighting fixture 100 is not storing the identification information of radio remote controller 200 serving as the master device and also the other configuration data items (such as data indicating a current dimming level, data indicating a current color-controlling level, etc.) is reset to initial values.

Initial state 2 refers to a state in which lighting fixture 100 is not storing the identification information of radio remote controller 200 serving as the master device. For example, paired lighting fixture 100 is brought into initial state 2 when unpaired.

If lighting fixture 100 is in initial state 1 at power on, lighting fixture 100 enters the simple configuration mode. Then, if lighting fixture 100 receives a pairing command which includes identification information from any radio remote controller 200, lighting fixture 100 immediately stores the identification information as identification information of radio remote controller 200 serving as a master device.

If lighting fixture 100 is in initial state 2 at power on, lighting fixture 100 enters the manual configuration mode. Then, if lighting fixture 100 receives a pairing command which includes identification information from any radio remote controller 200 and further receives a pairing trigger signal from infrared remote controller 300, lighting fixture 100 stores the identification information as identification information of radio remote controller 200 serving as a master device. Stated differently, if lighting fixture 100 that is in initial state 2 at power on receives a pairing command which includes identification information from any radio remote controller 200, lighting fixture 100 postpones storing the identification information as identification information of radio remote controller 200 serving as a master device until lighting fixture 100 receives a pairing trigger signal from infrared remote controller 300.

Radio remote controller 200 controls lighting fixture 100 paired with radio remote controller 200, using radio commands. In response to a user operation indicating initiating a pairing configuration mode, e.g., depression of a configuration mode button performed by the user, radio remote controller 200 repeatedly temporarily transmits a pairing command which includes identification information of its own. Temporarily as used herein may be, for example, five minutes, ten minutes, etc., or until a user operation indicating terminating the pairing configuration mode, e.g., depression of the configuration mode button performed again by the user.

Infrared remote controller 300 controls lighting fixture 100, using infrared commands. In the above-mentioned simple configuration mode, infrared remote controller 300 is not used. On the other hand, in the manual configuration mode, infrared remote controller 300 is used to transmit a pairing trigger signal to lighting fixture 100 which infrared remote controller 300 is to be paired with. In principle, infrared remote controller 300 is unable to control lighting fixture 100 that is paired with radio remote controller 200, but is able to control non-paired lighting fixture 100.

[1.2 Example of Installation of Lighting System]

Next, an example of installation of the lighting system is described.

Figure 2A:
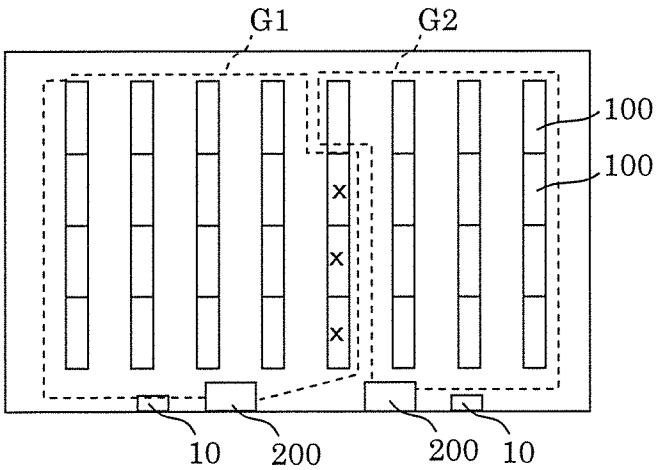
FIG. 2A is a schematic view of an installation example of the lighting system according to Embodiment 1.

FIG. 2A is a schematic view of an installation example of the lighting system according to Embodiment 1. The figure shows 32 lighting fixtures 100 installed, for example, on the ceiling of a room or a shop, two radio remote controllers 200 and two switches 10 installed on the wall. The dashed boxes each indicate a group of lighting fixtures 100. Group G1 includes 16 lighting fixtures 100 on the left side and three lighting fixtures 100 indicated by "x" marks. Group G2 includes 13 lighting fixtures 100 consisting of 16 lighting fixtures 100 on the right side minus the three lighting fixtures 100 indicated by "x" marks.

Assume that switch 10 on the left side corresponds to 16 lighting fixtures 100 on the left side, and switch 10 on the right side corresponds to 16 lighting fixtures 100 on the right side. In this case, groups G1 and G2 and two switches 10 are not in one-to-one correspondence, respectively.

None of lighting fixtures 100 immediately after the installation of the lighting system are paired with radio remote controllers 200. All lighting fixtures 100 are at factory default settings. The above groups G1 and G2 are paired with respective radio remote controllers 200 by, for example, such a procedure as:

(1-1) First, 16 lighting fixtures 100 on the left side are paired with radio remote controller 200 on the left side in the simple configuration mode. (1-2) Sixteen lighting fixtures 100 on the right side are paired with radio remote controller 200 on the right side in the simple configuration mode. (1-3) The three lighting fixtures 100 indicated by "x" marks are unpaired. (1-4) The three lighting fixtures 100 indicated by "x" marks are paired with radio remote controller 200 on the left side in the manual configuration mode.

Alternatively, groups G1 and G2 may be paired with respective radio remote controllers 200 by, for example, such a procedure as:

(2-1) Sixteen lighting fixtures 100 on the right side are paired with radio remote controller 200 on the right side in the simple configuration mode. (2-2) The three lighting fixtures 100 indicated by "x" marks are unpaired. (2-3) Sixteen lighting fixtures 100 on the left side and the three lighting fixtures 100 indicated by "x" marks are paired with radio remote controller 200 on the right side in the manual configuration mode.

The above two example ways of pairing processing allow a user (installer) to readily carry out the pairing configuration in the simple configuration mode, simply by operating switches 10 and radio remote controllers 200. In the manual configuration mode, the user can readily carry out the pairing configuration, simply by operating switches 10, radio remote controllers 200, and infrared remote controller 300. In addition, the user can readily unpair lighting fixtures 100 simply by operating infrared remote controller 300. Stated differently, the user can readily carry out the pairing configuration on individual lighting fixtures 100 that are installed at high location (i.e., the ceiling), without directly operating them.

Figure 2B:
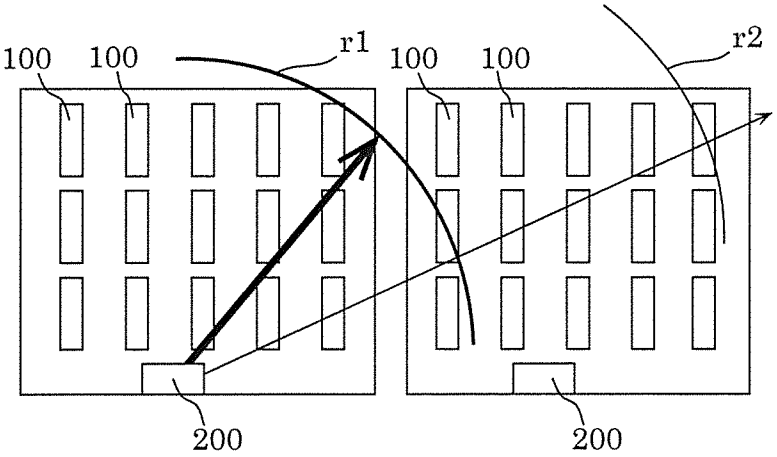
FIG. 2B is a schematic view of another installation example of the lighting system according to Embodiment 1.

FIG. 2B is a schematic view of another installation example of the lighting system according to Embodiment 1. The figure shows the lighting system installed across two adjacent rooms or two adjacent shops, for example. Fifteen lighting fixtures 100 and one radio remote controller 200 are installed in the room or shop on the left side. Fifteen lighting fixtures 100 and one radio remote controller 200 are installed in the room or shop on the right side. The arcs in the figure indicate coverage of radio waves transmitted by radio remote controller 200 on the left side. Arc r1 in bold indicates a rated radio coverage. Actual radio coverage, however, may go beyond the rated arc r1, depending on positional relationship between and installation environment of radio remote controller 200 and lighting fixtures 100. For example, a radio wave from radio remote controller 200 on the left side may reach arc r2 covering the adjacent room or shop. A newly constructed building may have a plurality of lighting systems installed at the same time in adjacent rooms or shops. Consequently, for example, lighting fixtures 100 installed in the room or shop on the right side may unintendedly receive a pairing command from radio remote controller 200 on the left side in the figure, and paired with that radio remote controller 200 on the left side unintentionally. Lighting fixtures 100 according to the present embodiment can readily be unpaired when they are paired with wrong radio remote controller 200, simply by using the unpairing signal from infrared remote controller 300. Stated differently, the user can readily unpair lighting fixtures 100 which are paired with wrong radio remote controller 200, without directly operating them.

[1.3 Configuration Example of Lighting Fixture]

Next, the configuration of lighting fixture 100 is described in detail.

Figure 3:
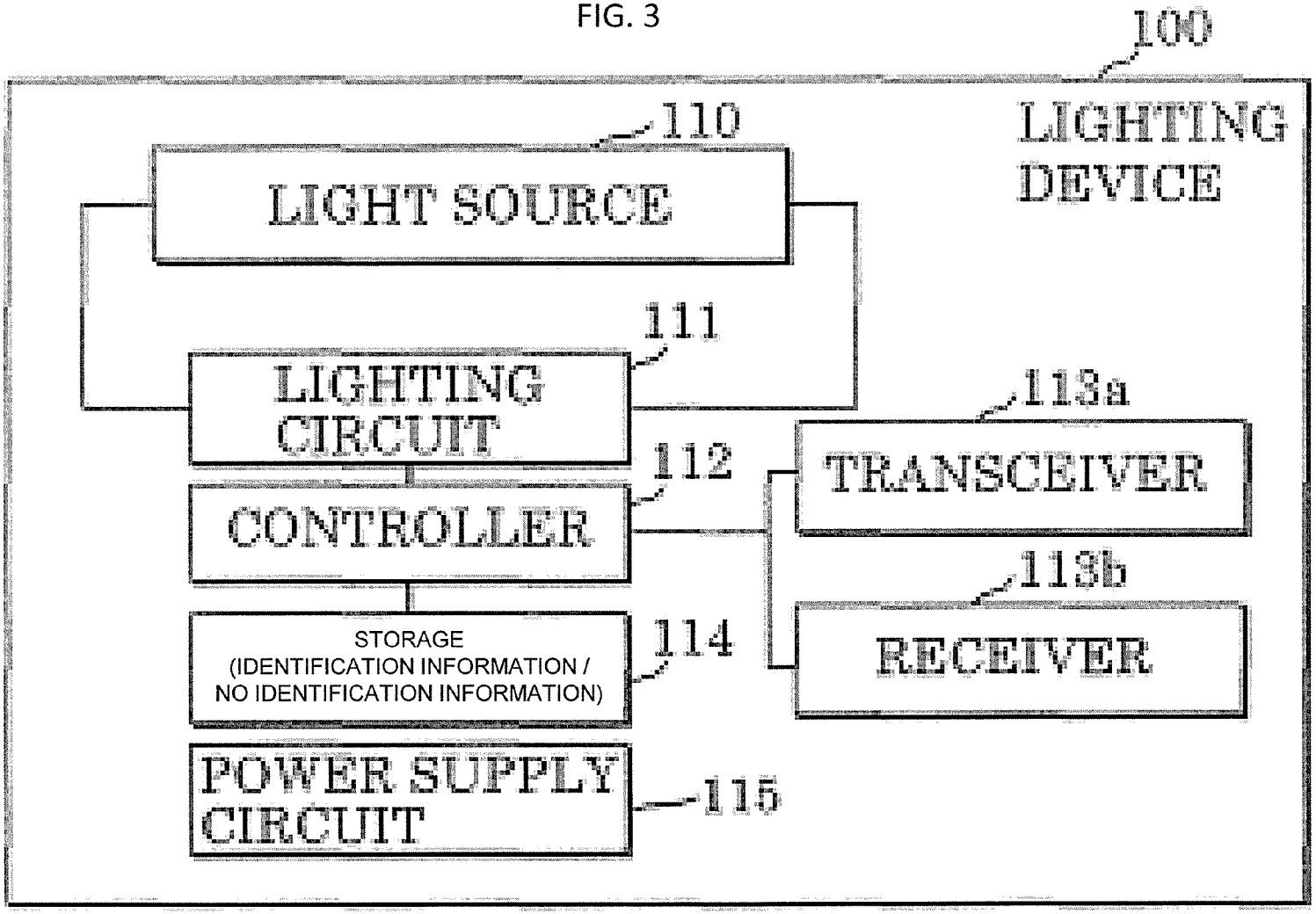
FIG. 3 is a block diagram of a configuration example of a lighting fixture according to Embodiment 1.

FIG. 3 is a block diagram of a configuration example of lighting fixture 100 according to Embodiment 1. As shown in the figure, lighting fixture 100 includes light source 110, lighting circuit 111, controller 112, communicator 113, storage 114, and power supply circuit 115.

Light source 110 includes one or more light emitting elements. The one or more light emitting elements are, for example, a plurality of light emitting diode (LED) elements. It should be noted that the one or more light emitting elements are not limited to LED elements. Light source 110 may include, for example, semiconductor light emitting elements such as semiconductor lasers, or solid state light-emitting devices such as organic electro luminescent (EL) elements, or inorganic EL elements. Alternatively, light source 110 may be TL lamps as lighting fixture 100 shown in FIGS. 2A and 2B, or may be fluorescent ring lights, or downlights.

Lighting circuit 111 supplies light source 110 with a voltage or current for causing light source 110 to emit light, blink, or stop emitting light, for example. If light source 110 includes a plurality of LED elements, the voltage or current depends on an illumination mode, such as a dimming ratio, a color-controlling ratio, for example.

Controller 112 controls lighting circuit 111, in correspondence to a plurality of illumination modes. Specifically, controller 112 controls the following functions of lighting circuit 111, for example: a dimming function of controlling brightness, a color control function of adjusting a color temperature, a fading function of adjusting brightness over time, etc. Controller 112 operates according to a radio command received via transceiver 113*a* from radio remote controller 200, and an infrared command received via receiver 113*b* from infrared remote controller 300.

Moreover, controller 112 determines, at power on of lighting fixture 100, whether lighting fixture 100 is in the initial state in which lighting fixture 100 is not storing identification information of radio remote controller 200 serving as a master device in storage 114. If lighting fixture 100 is in the initial state, lighting fixture 100 enters the pairing configuration mode. If controller 112 receives a pairing command which includes the identification information of radio remote controller 200 in the pairing configuration mode, controller 112 stores the identification information into storage 114, and then causes lighting fixture 100 to operate according to a radio command which includes the identification information. It should be noted that controller 112 may be an IC, or may be configured of a microprocessor and program.

As the pairing configuration mode, controller 112 selects either one of the simple configuration mode and the manual configuration mode, depending on the state of lighting fixture 100. If controller 112 selects the simple configuration mode and then receives a pairing command which includes the identification information, controller 112 immediately stores the identification information into storage 114. If controller 112 selects the manual configuration mode and then receives a pairing command which includes the identification information, controller 112 postpones storing the identification information until receiving a pairing trigger signal from infrared remote controller 300.

It should be noted that in the pairing configuration mode, controller 112 in step S75 may not only store the identification information but also transmit a response signal which includes identification information of lighting fixture 100 to radio remote controller 200 serving as the master device.

Transceiver 113*a* receives radio commands from radio remote controller 200. The radio commands include the above-mentioned pairing command, and a radio command indicating dimming or color-controlling, for example.

Receiver 113*b* receives an infrared command, a pairing trigger signal, and an unpairing signal from infrared remote controller 300.

Storage 114 stores information, including identification information of radio remote controller 200 serving as the master device, data indicating a current dimming level, data indicating a current color-controlling level, model information of lighting fixture 100, and flags indicating states of lighting fixture 100, for example. At factory default settings, identification information of radio remote controller 200 is an invalid value, and the other data items are default values. The flags indicating states of lighting fixture 100 may include a flag indicating whether lighting fixture 100 is at factory default settings, and a flag indicating whether identification information of radio remote controller 200 is usable or unusable.

Power supply circuit 115 supplies power to the components included in lighting fixture 100.

According to the configuration of lighting fixture 100 described above, the simple configuration mode allows lighting fixture 100 to be paired in a simple manner, without requiring a pairing trigger signal from infrared remote controller 300. The manual configuration mode certainly allows lighting fixture 100 that has received a pairing trigger signal from infrared remote controller 300 to be selectively paired with infrared remote controller 300 from among the plurality of lighting fixtures 100. Both the simple configuration mode and manual configuration mode allow the user to readily carry out the pairing configuration of lighting fixtures 100, without the user directly operating them.

[1.4 Command Receive Process in Lighting System]

Next, a command receive process performed by lighting fixture 100 is described.

Figure 4:
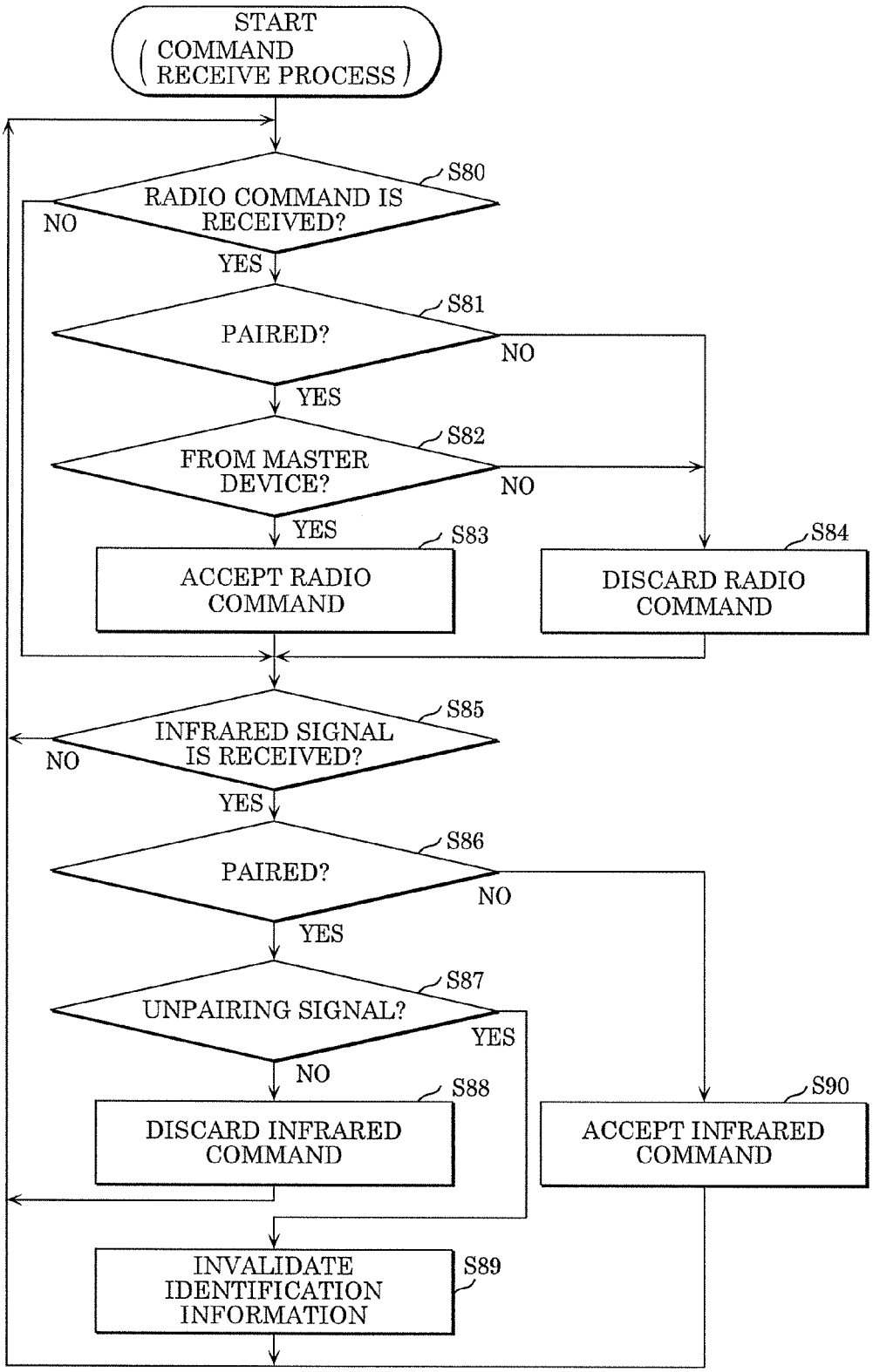
FIG. 4 is a flowchart illustrating one example of a command receive process performed by the lighting fixture according to Embodiment 1.

FIG. 4 is a flowchart illustrating an example of the command receive process performed by lighting fixture 100 according to Embodiment 1.

If lighting fixture 100 receives a radio command (yes in S80), lighting fixture 100 determines whether it is being paired with a master device and whether the radio command is transmitted from the master device (S81, S82). If the determination indicates that lighting fixture 100 is being paired with a master device (yes in S81), and the radio command is transmitted from radio remote controller 200 serving as the master device (yes in S82), lighting fixture 100 accepts the radio command (S83). On the other hand, if lighting fixture 100 is not being paired (no in S81), lighting fixture 100 ignores the radio command. If the radio command is not from the master device (no in S82), lighting fixture 100 ignores the radio command (S84).

If lighting fixture 100 receives an infrared signal (yes in S85), lighting fixture 100 determines whether it is being paired with a master device (S86). If lighting fixture 100 is being paired with a master device, lighting fixture 100 determines whether the infrared signal is an unpairing signal (S87).

If the determination indicates that lighting fixture 100 is being paired with a master device (yes in S86), and the infrared signal is not an unpairing signal (no in S87), lighting fixture 100 ignores the infrared signal (an infrared command in this case) (S88). If the infrared signal is an unpairing signal (yes in S87), lighting fixture 100 makes the identification information stored in storage 114 unusable (S89). The identification information made unusable by lighting fixture 100 is regarded to be not stored in storage 114. On the other hand, if lighting fixture 100 is being not paired (no in S86), lighting fixture 100 accepts the infrared signal (S90).

Lighting fixture 100 accepts the radio command (S83). However, if lighting fixture 100 is not being paired (no in S81), or if the radio command is not from the master device (no in S82), lighting fixture 100 ignores the radio command (S84).

In this manner, in the lighting system which includes a plurality of lighting fixtures 100 and radio remote controller 200, both paired lighting fixture 100 and non-paired lighting fixture 100 are readily controllable. Specifically, lighting fixture 100 not paired with radio remote controller 200 is controllable by infrared remote controller 300.

For example, if there is lighting fixture 100 that is not paired with radio remote controller 200 at installation of the lighting system, that lighting fixture 100 is uncontrollable by radio remote controller 200, but infrared remote controller 300 can control lighting fixture 100 such that lighting fixture 100 emits light and stops emitting light. For example, in the case where a corner of a room where the lighting system is installed is laid out as a meeting area, among the plurality of lighting fixtures 100, lighting fixtures 100 corresponding to the meeting area are controllable by infrared remote controller 300 once they are unpaired and released from control by radio remote controller 200, such that they emit light on when a meeting is held, and stop emitting light when the meeting ends.

As described above, according to the control method, the lighting fixture, and the lighting system of the present embodiment, the pairing configuration is readily carried out in a few steps in the lighting system which includes the plurality of lighting fixtures 100 and radio remote controller 200.

[1.5 Configuration Example of Radio Remote Controller]

Figure 5:
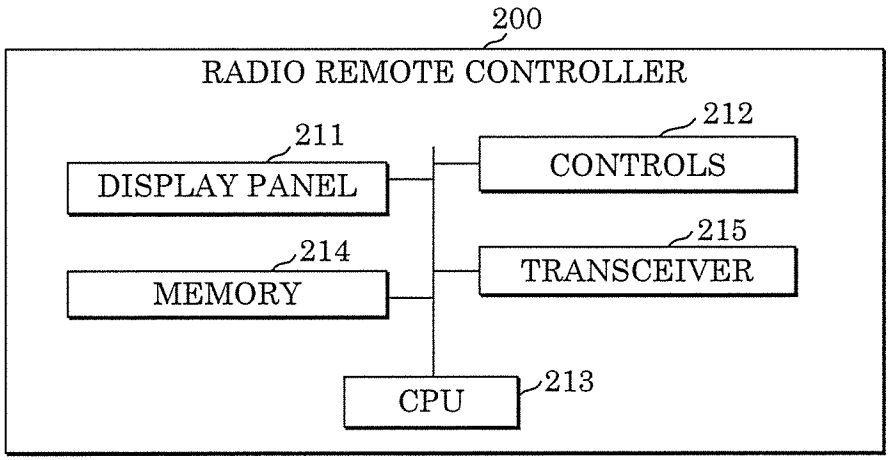
FIG. 5 is a block diagram of a configuration example of a radio remote controller according to Embodiment 1.

FIG. 5 is a block diagram of a configuration example of radio remote controller 200 according to Embodiment 1. As shown in the figure, radio remote controller 200 includes display panel 211, controls 212, CPU 213, memory 214, and transceiver 215.

Display panel 211 is, for example, a liquid crystal display panel and displays a current state (an operation mode, lighting state, time, etc.).

Controls 212 include a plurality of operation buttons. The plurality of operation buttons include a configuration mode button for indicating initiating or terminating the pairing configuration mode, an UP button for increasing the dimming level, and a DOWN button for decreasing the dimming level, for example.

CPU 213 executes programs stored in memory 214 thereby controlling the operation of radio remote controller 200, and transmission of a radio command. Specifically, CPU 213 transmits, according to a user operation made using controls 212, a radio command to lighting fixture 100 via transceiver 215, thereby controlling lighting fixture 100. For example, as a user depresses the configuration mode button, CPU 213 repeatedly temporarily transmits, via transceiver 215, a pairing command which includes identification information of radio remote controller 200. The repeated cycles may be 0.5 seconds or a few hundred mS each, for example. Temporarily as used herein may be, for example, a predetermined time such as five minutes or ten minutes, or until a user operation indicating terminating the pairing configuration mode, e.g., depression of the configuration mode button performed again by the user.

Memory 214 stores data and programs which are executed by CPU 213. If memory 214 receives a response signal which includes identification information of lighting fixture 100 from lighting fixture 100 in the pairing configuration mode, memory 214 stores the identification information of lighting fixture 100 as pairing information.

Transceiver 215 transmits and receives radio commands, according to control by CPU 213.

To pair lighting fixtures 100 with radio remote controller 200 during the installation, radio remote controller 200 enters the pairing configuration mode by the user simply depressing the configuration mode button on radio remote controller 200 in such a manner. Specifically, in the simple configuration mode, the user can pair lighting fixtures 100 with radio remote controller 200 simply by turning switch 10 on and depressing the configuration mode button on radio remote controller 200.

[1.6 Configuration Example of Infrared Remote Controller]

Figure 6:
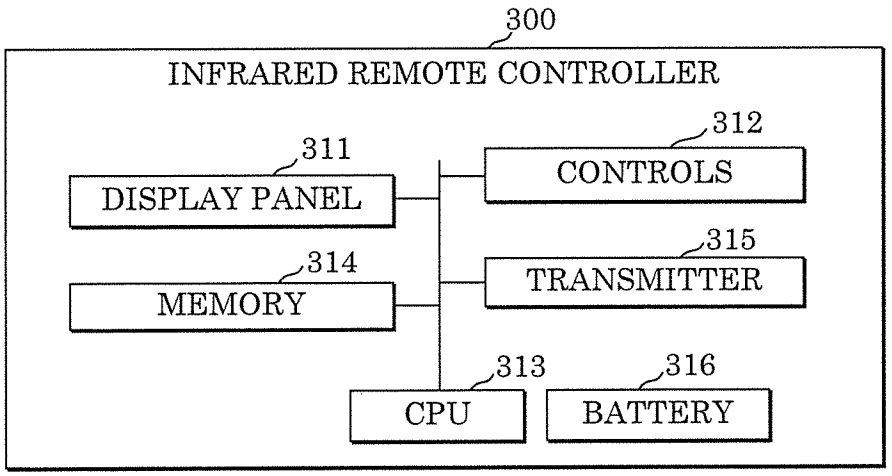
FIG. 6 is a block diagram of a configuration example of an infrared remote controller according to Embodiment 1.

FIG. 6 is a block diagram of a configuration example of infrared remote controller 300 according to Embodiment 1. As shown in the figure, infrared remote controller 300 includes display panel 311, controls 312, CPU 313, memory 314, transmitter 315, and battery 316.

Display panel 311 is, for example, a liquid crystal display panel and displays a current state (an operation mode, lighting state, time, etc.).

Controls 312 include a plurality of operation buttons. The plurality of operation buttons include a pairing trigger button, an unpairing button, an ON button, an OFF button, for example. The pairing trigger button is for transmitting a pairing trigger signal. The unpairing button is for transmitting an unpairing signal. The ON button is for causing lighting fixture 100 to emit light. The OFF button is for causing lighting fixture 100 to stop emitting light.

CPU 313 executes programs stored in memory 314, thereby controlling the operation of infrared remote controller 300, and transmission of an infrared command, pairing trigger signal, and unpairing signal.

Memory 314 stores data and programs which are executed by CPU 313.

Transmitter 315 is, for example, an infrared-light emitting element such as an infrared LED, and transmits an infrared command, pairing trigger signal, and unpairing signal, according to control by CPU 213. Infrared remote controller 300 emits, to a target lighting fixture 100, infrared light which has a narrow light distribution that does not concurrently reach lighting fixtures 100 adjacent to the target lighting fixture 100. The light distribution of infrared light emitted from infrared remote controller 300 and a distance between adjacent two lighting fixtures 100 are adjusted such that the infrared light does not concurrently reach the two adjacent lighting fixtures 100. An angle of light distribution of infrared light emitted from infrared remote controller 300 may be less than a predetermined angle which may be, for example, 45 degrees, 30 degrees, or 20 degrees. For example, if the user near the target lighting fixture 100 aims infrared remote controller 300 toward the target lighting fixture 100 and infrared remote controller 300 emits an infrared signal, other lighting fixtures 100 adjacent to the target lighting fixture 100 do not receive the infrared signal emitted from infrared remote controller 300. Stated differently, infrared remote controller 300 is able to transmit an infrared command to individual lighting fixtures 100.

Battery 316 supplies infrared remote controller 300 with power.

[2.1 Example of Operation of Lighting System During Pairing Configuration]

Operation of the lighting system according to the present embodiment configured as set forth above is described below.

First, operation of radio remote controller 200 in the pairing configuration mode is to be described.

Figure 7:
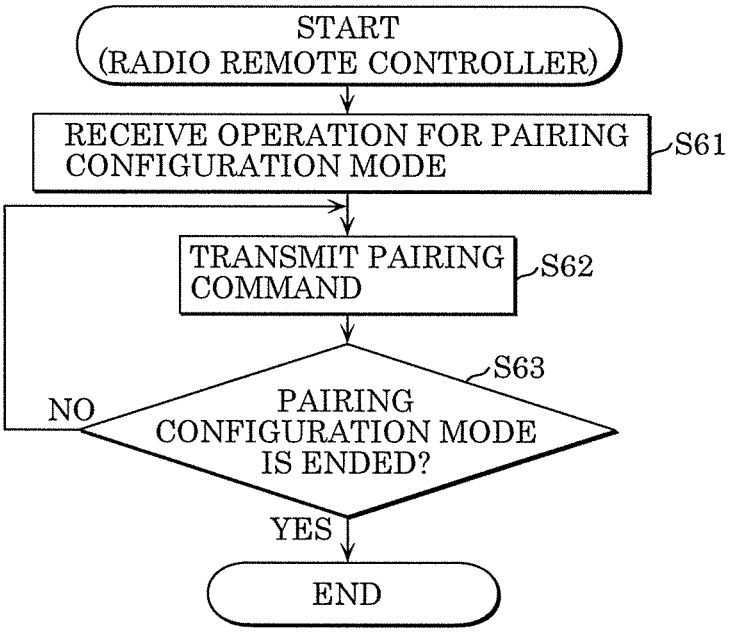
FIG. 7 is a flowchart illustrating an example of processing performed by the radio remote controller according to Embodiment 1 in a pairing configuration mode.

FIG. 7 is a flowchart illustrating an example of processing performed by radio remote controller 200 according to Embodiment 1 in the pairing configuration mode.

The user performs pairing configuration mode initiating operation, using radio remote controller 200 to be a master device. Here, the pairing configuration mode initiating operation is depression of the configuration mode button on radio remote controller 200.

If radio remote controller 200 receives the pairing configuration mode initiating operation (S61), radio remote controller 200 repeatedly temporarily transmits a pairing command which includes identification information of radio remote controller 200 (S62, S63). The pairing command includes, for example, a broadcast address as a destination. In step S63, for example, the pairing configuration mode may be ended once ten minutes have passed. Alternatively, the pairing configuration mode may be ended once the user depresses the configuration mode button. Still alternatively, the pairing configuration mode may be ended once either one of the above conditions is satisfied, which are the elapse of ten minutes and depression of the configuration mode button performed by the user.

In this manner, the user can readily place radio remote controller 200 into the pairing configuration mode by simply depressing the configuration mode button.

Next, the operation performed by lighting fixture 100 during pairing configuration is described.

Figure 8:
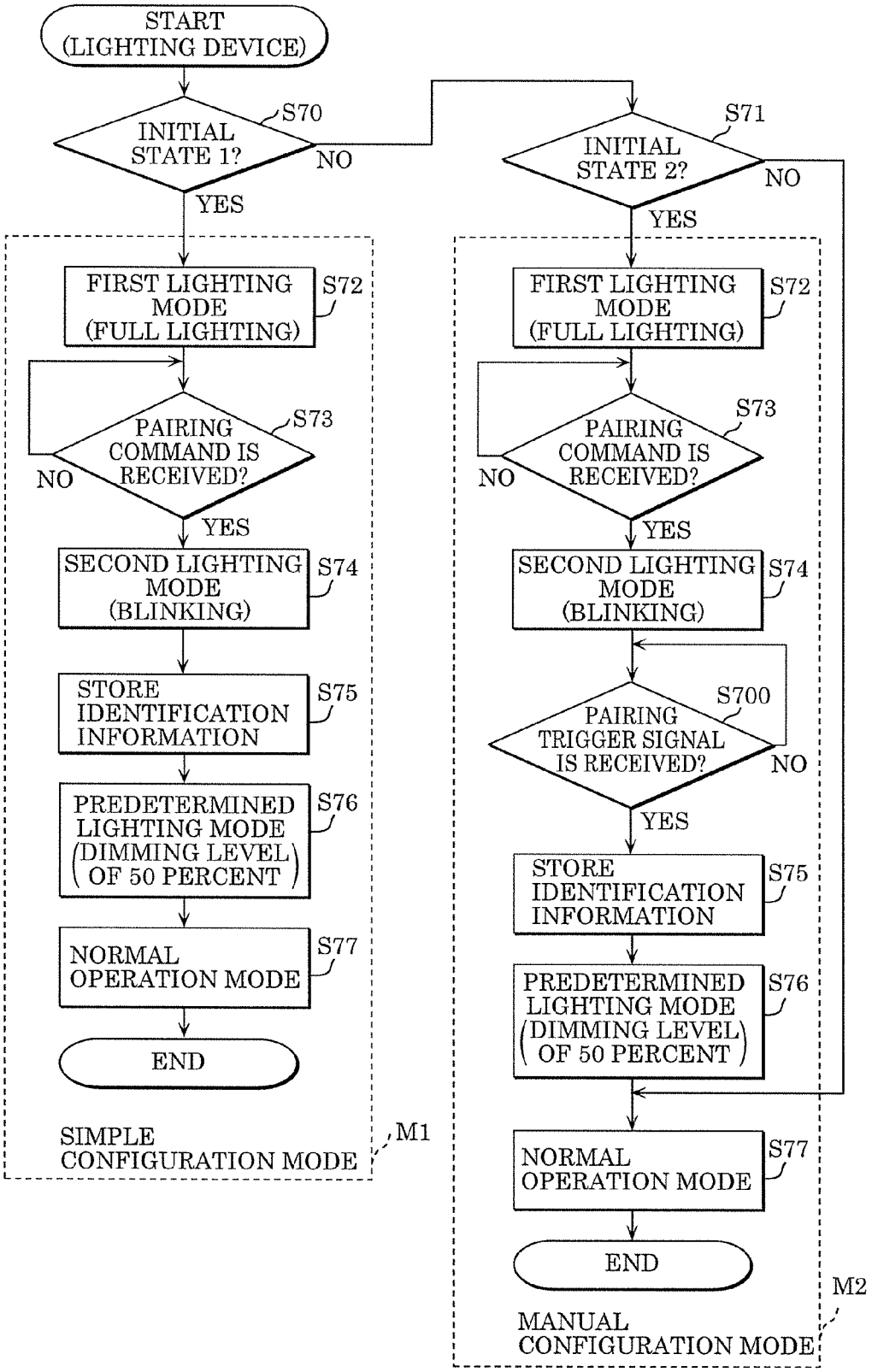

FIG. 8 is a flowchart illustrating an example of processing performed by lighting fixture 100 according to Embodiment 1 at power on.

The user turns on switch 10 that corresponds to lighting fixture 100 for which the user is to carry out pairing configuration.

Lighting fixture 100 at power on determines whether it is in initial state 1, that is, at factory default settings. If lighting fixture 100 is in initial state 1 (yes in S70), lighting fixture 100 enters simple configuration mode M1. If lighting fixture 100 is not in initial state 1 (no in S70), lighting fixture 100 determines whether it is in initial state 2, that is, whether lighting fixture 100 is storing identification information of a master device. If lighting fixture 100 is in initial state 2 (yes in S71), lighting fixture 100 enters manual configuration mode M2. If lighting fixture 100 is not in initial state 2 (no in S71), lighting fixture 100 enters a normal operation mode.

Lighting fixture 100 enters simple configuration mode M1 when, for example, lighting fixture 100 is powered on by switch 10 for the first time after the installation of the lighting system in a room or shop. Lighting fixture 100 after being unpaired enters manual configuration mode M2 at power on.

First, simple configuration mode M1 is described.

In simple configuration mode M1, lighting fixture 100 emits light in a first illumination mode (e.g., full lights on, i.e., a dimming level of 100%) (S72). Then, lighting fixture 100 emits light in a second illumination mode (e.g., blinks) once lighting fixture 100 receives a pairing command from any radio remote controller 200 (S73) (S74).

This allows, at power on of lighting fixtures 100 during the installation of the lighting system which includes the plurality of lighting fixtures 100 and radio remote controller 200, the user (i.e., installer) to distinguish between lighting fixture 100 not being paired and lighting fixture 100 being paired, and further distinguish whether each lighting fixture 100 receives a pairing command. In this manner, the user is able to check to be sure of the progress of the installation of the lighting system.

Next, lighting fixture 100 having received a pairing command stores identification information included in the pairing command as identification information of a master device (S75), emits light in a predetermined illumination mode (e.g., a dimming level of 50%) (S76), and enters an operation mode (S77) in which lighting fixture 100 operates according to a radio command which includes the identification information of the master device.

As such, during the installation of the lighting system which includes the plurality of lighting fixtures 100 and radio remote controller 200, simple configuration mode M1 allows the user to carry out the pairing configuration in a few steps. Specifically, the user depresses the configuration mode button on radio remote controller 200 and turns switch 10 on, thereby pairing lighting fixture 100 corresponding to switch 10, with radio remote controller 200.

Next, manual configuration mode M2 is described.

Lighting fixture 100 determined to be in initial state 2 in step S71 enters manual configuration mode M2. As illustrated in FIG. 8, manual configuration mode M2 is the same as simple configuration mode M1, except that step S700 is performed after step S74 and before step S75. Description is to be set forth below, focusing on processes different from the processes performed in simple configuration mode M1.

In the manual configuration mode, if lighting fixture 100 receives a pairing command, lighting fixture 100 postpones storing identification information included in the pairing command until receiving a pairing trigger signal from infrared remote controller 300. In other words, lighting fixture 100 determines whether it has received the pairing trigger signal. If lighting fixture 100 has received the pairing trigger signal, lighting fixture 100 stores the identification information (S700). As such, the manual configuration mode allows a desired lighting fixture 100 to be selectively paired with infrared remote controller 300 from among the plurality of lighting fixtures 100 corresponding to switch 10. In other words, the manual configuration mode certainly allows lighting fixture 100 that has received the pairing trigger signal from infrared remote controller 300 to be selectively paired with infrared remote controller 300 from among the plurality of lighting fixtures 100.

It should be noted that in step S75, if lighting fixture 100 may additionally transmit a response signal which includes own identification information to radio remote controller 200, and radio remote controller 200 may individually control lighting fixture 100 with which radio remote controller 200 is paired. For example, radio remote controller 200 may transmit, to lighting fixture 100 with which radio remote controller 200 is paired, a radio command indicating unpairing of that lighting fixture 100.

Embodiment 2

Next, a lighting system according to Embodiment 2 is described. Embodiment 1 has been described, with reference to the example in which lighting fixture 100 enters the simple configuration mode if lighting fixture 100 is in initial state 1 at power on, and enters the manual configuration mode if lighting fixture 100 is in initial state 2 at power on. In contrast, in the lighting system according to the present embodiment, a pairing command is either one of a simple configuration command and manual configuration command, and either one of the simple configuration mode and the manual configuration mode is selected depending on the pairing command from radio remote controller 200.

The lighting system according to the present embodiment has the same configuration as the block diagrams shown in FIGS. 1, 3, 5, and 6, except that a pairing command is either one of a simple configuration command and manual configuration command, and an operation corresponding to the pairing command is different. Description is to be described below, focusing on the differences.

Figure 9:
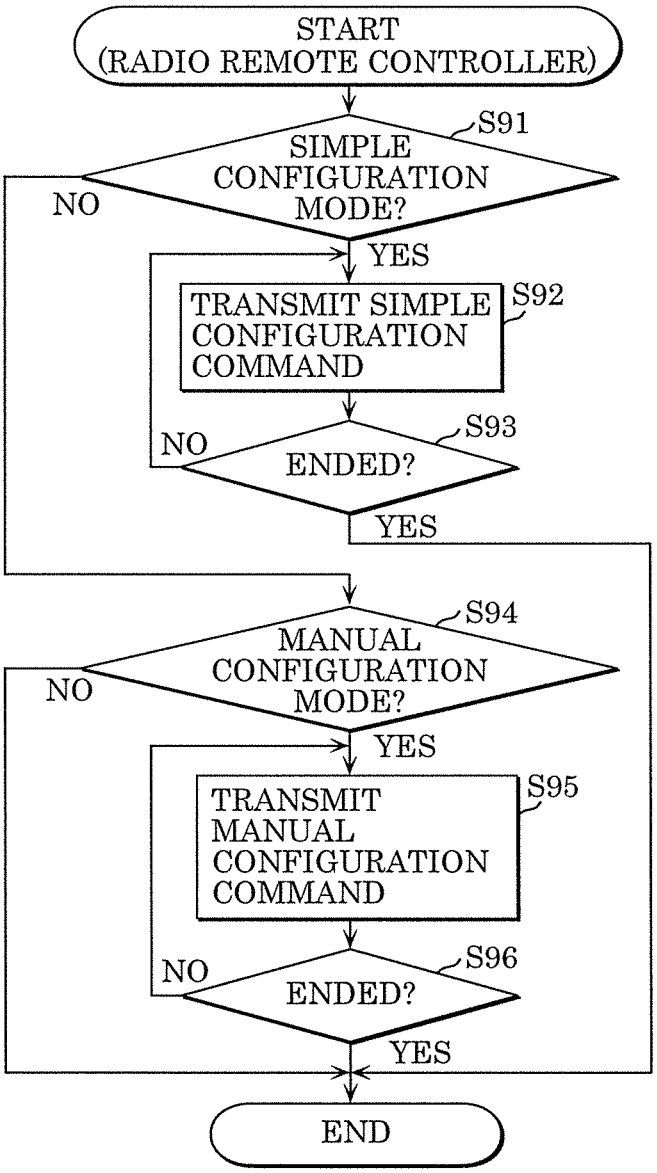
FIG. 9 is a flowchart illustrating an example of processing performed by a radio remote controller according to Embodiment 2 in a pairing configuration mode.

FIG. 9 is a flowchart illustrating an example of processing performed by radio remote controller 200 according to Embodiment 2 in a pairing configuration mode.

A user performs pairing configuration mode initiating operation, using radio remote controller 200 to be a master device. For example, simple configuration mode initiating operation is depression of a simple configuration mode button, and manual configuration mode initiating operation is depression of a manual configuration mode button. It should be noted that the pairing configuration mode initiating operation may be selecting either one of the simple configuration mode and the manual configuration mode on a menu shown on display panel 211.

If radio remote controller 200 receives the simple configuration mode initiating operation (S91), radio remote controller 200 repeatedly temporarily transmits a simple configuration command as a pairing command which includes identification information of radio remote controller 200 (S92, S93).

If radio remote controller 200 receives the manual configuration mode initiating operation (S94), radio remote controller 200 repeatedly temporarily transmits a manual configuration command, as a pairing command which includes identification information of radio remote controller 200 (S95, S96).

The above pairing command (the simple configuration command and manual configuration command) includes, for example, a broadcast address as a destination. In steps S93 and S96, for example, the pairing configuration mode may be ended once ten minutes have passed. Alternatively, the pairing configuration mode may be ended once the user depresses the configuration mode button. Still alternatively, the pairing configuration mode may be ended once either one of the above conditions is satisfied, which are the elapse of ten minutes and depression of the configuration mode button performed by the user.

In this manner, the user is allowed to select either one of the simple configuration mode and the manual configuration mode as the pairing configuration mode.

Figure 10:
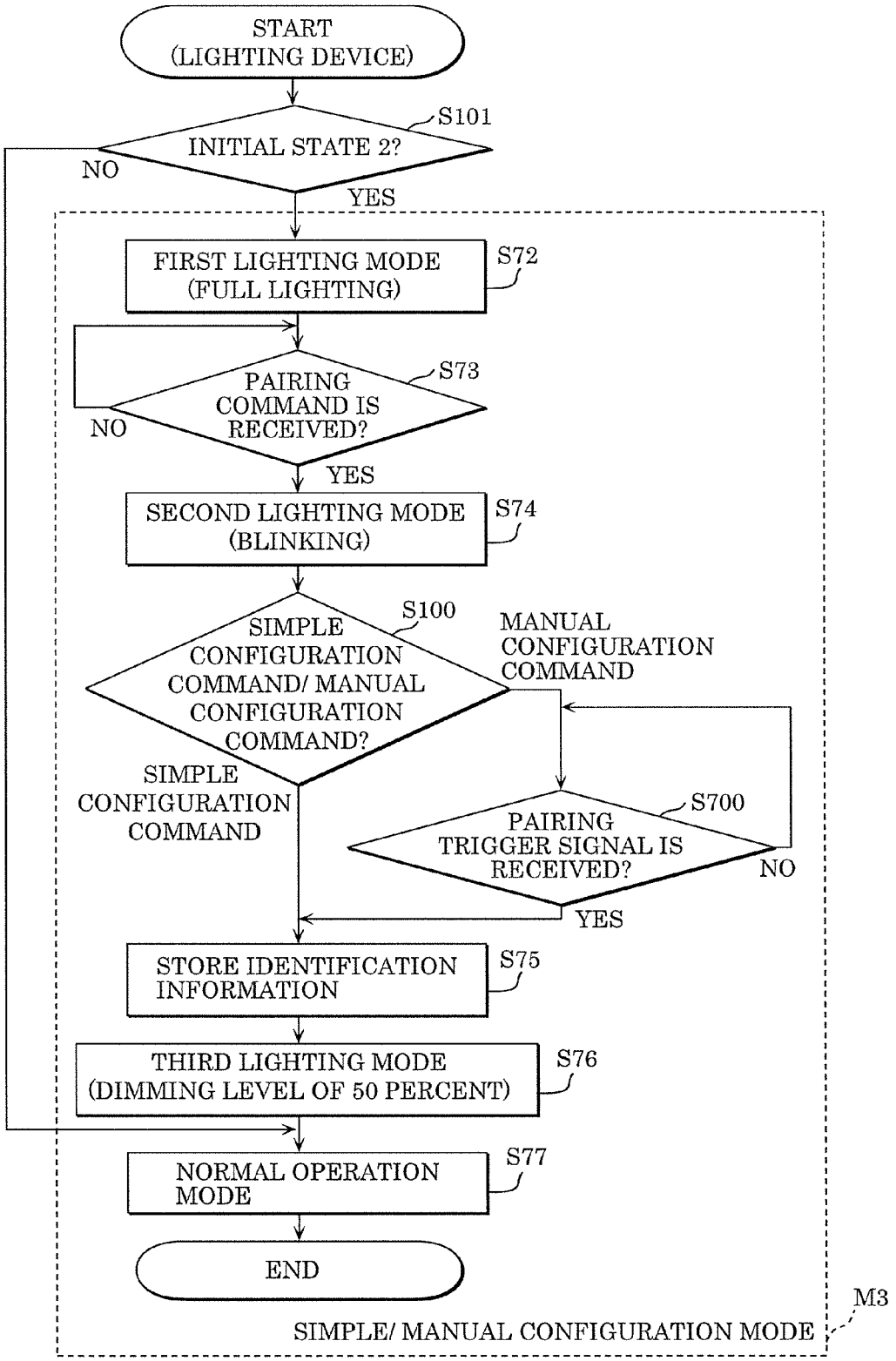

FIG. 10 is a flowchart illustrating an example of processing performed by lighting fixture 100 according to Embodiment 2 at power on. In the figure, lighting fixture 100 determines whether it is in initial state 2 immediately after the power on (S101). Initial state 2, as already described, refers to a state in which lighting fixture 100 is not storing the identification information of radio remote controller 200 serving as the master device in storage 114.

If lighting fixture 100 is in initial state 2 (yes in S101), lighting fixture 100 enters simple/manual configuration mode M3. If lighting fixture 100 is not in initial state 2 (no in S101), lighting fixture 100 enters a normal operation mode (S77).

Simple/manual configuration mode M3 is the same as simple configuration mode M1 illustrated in FIG. 8, except that steps S100 and S700 are performed immediately after step S74 and before S75. Description is to be described below, focusing on processes different from the processes performed in simple configuration mode M1.

Lighting fixture 100 determines whether the pairing command received in step S73 is a simple configuration command or manual configuration command (S100).

If the pairing command is a simple configuration command (yes in S100), lighting fixture 100 immediately stores identification information included in the pairing command (S75).

If the pairing command is a manual configuration command (no in S100), lighting fixture 100 postpones storing the identification information until lighting fixture 100 receives a pairing trigger signal from infrared remote controller 300 (S700).

As described above, according to the control method, lighting fixture 100, and the lighting system of the present embodiment, if the pairing command is a simple configuration command, lighting fixture 100 can be readily paired with a master device, without requiring a pairing trigger signal from infrared remote controller 300. In other words, the simple configuration command allows lighting fixture 100 to readily be paired with a master device in the simple configuration mode.

On the other hand, if the pairing command is a manual configuration command, a desired lighting fixture 100 is selectively paired with infrared remote controller 300 from among the plurality of lighting fixtures 100. In other words, the manual configuration mode certainly allows lighting fixture 100 that has received the pairing trigger signal from infrared remote controller 300 to be selectively paired with infrared remote controller 300 from among the plurality of lighting fixtures 100.

Moreover, during the installation of the lighting system, the user (installer) is allowed free selection, using radio remote controller 200, from among the simple configuration mode and manual configuration mode, as a pairing configuration mode.

It should be noted that lighting fixture 100 according to Embodiment 1 may (a) enter the simple configuration mode if lighting fixture 100 receives a pairing command immediately after power on (e.g., within two seconds after power-on), (b) enter the manual configuration mode if lighting fixture 100 receives a pairing command at the other times (e.g., two or more seconds after power-on). Action (a) corresponds to an action in which lighting fixture 100 is powered on while radio remote controller 200 is in the pairing configuration mode. Action (b) corresponds to an action in which radio remote controller 200 enters the pairing configuration mode after lighting fixture 100 is powered on (e.g., after two or more seconds 2).

Alternatively, in Embodiment 2 also, as with Embodiment 1, radio remote controller 200 may transmit a pairing command (which has no distinction of the simple configuration command and manual configuration command), and distinguish between the simple configuration mode and the manual configuration mode, based on whether lighting fixture 100 falls in the above action (a) or (b).

It should be noted that lighting fixture 100 may operate according to the following actions (A) and (B), instead of the above actions (a) and (b). Upon receipt of a pairing command, if (A) lighting fixture 100 is currently in the pairing configuration mode (waiting for a pairing command step in S73), lighting fixture 100 enters the simple configuration mode, and if (B) lighting fixture 100 is currently not in the pairing configuration mode, (if lighting fixture 100 is in the normal operation mode), lighting fixture 100 enters the manual configuration mode. The actions (A) and (B) and the simple configuration mode and the manual configuration mode may be inverted.

As described above, lighting fixture 100 according to the above embodiments receives a radio command from radio remote controller 200 for operating lighting fixture 100, and an infrared command from infrared remote controller 300 for operating lighting fixture 100, lighting fixture 100 including: transceiver 113*a* which receives the radio command; receiver 113*b* which receives the infrared command; storage 114 for storing identification information of radio remote controller 200; and controller 112 which if the identification information is stored in storage 114, accepts a radio command that includes identification information same as the identification information stored in storage 114, among radio commands received by transceiver 113*a*, and ignores the infrared command received by receiver 113*b*, and if no identification information is stored in storage 114, accepts the infrared command received by receiver 113*b*.

According to the above configuration, in the lighting system which includes the plurality of lighting fixtures 100 and radio remote controller 200, both paired lighting fixture 100 and non-paired lighting fixture 100 are readily controllable. Specifically, lighting fixture 100 not paired with radio remote controller 200 is controllable by infrared remote controller 300.

For example, if there is lighting fixture 100 that is not paired with radio remote controller 200 at installation of the lighting system, that lighting fixture 100 is uncontrollable by radio remote controller 200, but infrared remote controller 300 can control that lighting fixture 100 such that lighting fixture 100 emits light and stops emitting light.

For example, in the case where a corner of a room where the lighting system is installed is laid out as a meeting area, among the plurality of lighting fixtures 100, lighting fixtures 100 corresponding to the meeting area are controllable by infrared remote controller 300 once they are unpaired and released from control by radio remote controller 200, such that they emit light on when a meeting is held, and stop emitting light when the meeting ends.

Here, controller 112 may make the identification information stored in storage 114 unusable if receiver 113*b* receives an unpairing signal.

According to the above configuration, a desired lighting fixture 100 can be excluded from being controlled by radio remote controller 200. For example, to change lighting fixtures 100 which are controlled by radio remote controller 200 due to change of a room layout, a desired lighting fixture 100 can readily be unpaired by infrared remote controller 300. For example, lighting fixtures 100, which has unexpectedly been paired with radio remote controller 200 in the simple configuration mode, can readily be unpaired.

Here, controller 112 may: determine, immediately after lighting fixture 100 is powered on, whether the identification information of radio remote controller 200 is stored in storage 114, cause lighting fixture 100 to enter a pairing configuration mode if controller 112 determines that the identification information of radio remote controller 200 is not stored in storage 114, and in the pairing configuration mode, when transceiver 113*a* receives, from radio remote controller 200, a pairing command which includes identification information and receiver 113*b* receives a pairing trigger signal from infrared remote controller 300, store the identification information included in the pairing command into storage 114.

According to the above configuration, if the pairing command is a manual configuration command, a desired lighting fixture 100 is selectively paired with radio remote controller 200 from among the plurality of lighting fixtures 100. In other words, the manual configuration mode certainly allows lighting fixture 100 that has received the pairing trigger signal from infrared remote controller 300 to be selectively paired with radio remote controller 200 from among the plurality of lighting fixtures 100.

Here, controller 112 may: cause lighting fixture 100 to emit light in a first illumination mode if controller 112 determines that the identification information of radio remote controller 200 is not stored in storage 114, cause lighting fixture 100 to emit light in a second illumination mode if controller 112 receives the pairing command in the pairing configuration mode, and cause lighting fixture 100 to emit light in a third illumination mode, after storing the identification information included in the pairing command into storage 114.

According to the above configuration, at power on of lighting fixtures 100 during the installation of the lighting system which includes the plurality of lighting fixtures 100 and radio remote controller 200, the user (i.e., installer) is allowed to distinguish between lighting fixture 100 not being paired and lighting fixture 100 being paired, and also distinguish whether each lighting fixture 100 receives a pairing command. Furthermore, the user (i.e., installer) is allowed to distinguish between lighting fixture 100 whose pairing configuration is completed and lighting fixture 100 whose pairing configuration is incomplete. In this manner, the user is able to check to be sure of the progress of the installation of the lighting system.

Moreover, the lighting system according to the embodiment includes lighting fixtures 100 which receive a radio command from radio remote controller 200 for operating lighting fixtures 100, and an infrared command from infrared remote controller 300 for operating lighting fixtures 100; radio remote controller 200 configured to operate in a pairing configuration mode in which radio remote controller 200 transmits, repeatedly for a predetermined time period, a pairing command which includes identification information of radio remote controller 200, and a normal operation mode in which radio remote controller 200 transmits the radio commands; and infrared remote controller 300 which transmits the infrared command to at least one of the lighting fixtures 100, wherein lighting fixtures 100 each include: transceiver 113*a* which receives the radio command; receiver 113*b* which receives the infrared command; storage 114 for storing the identification information of radio remote controller 200; and controller 200 which if the identification information is stored in storage 114, accepts a radio command that includes identification information same as the identification information stored in storage 114, among radio commands received by transceiver 113*a*, and ignores the infrared command received by receiver 113*b*, and if no identification information is stored in storage 114, accepts the infrared command received by receiver 113*b*.

According to the above configuration, in the lighting system which includes the plurality of lighting fixtures 100 and radio remote controller 200, both paired lighting fixture 100 and non-paired lighting fixture 100 are readily controllable. Specifically, lighting fixture 100 not paired with radio remote controller 200 is controllable by infrared remote controller 300.

Here, infrared remote controller 300 may emit, to lighting fixture 100 among lighting fixtures 100, infrared light which has a light distribution that does not concurrently reach lighting fixture 100 adjacent to lighting fixture 100 to which infrared remote controller 300 emits the infrared light.

According to the above configuration, infrared remote controller 300 is allowed to transmit an infrared signal to individual lighting fixtures 100, without concurrently transmitting the infrared signal over two or more of lighting fixtures 100.

Moreover, the method according to the above embodiments is a method performed by lighting fixture 100 which receives a radio command from radio remote controller 200 for operating lighting fixture 100, and an infrared command from infrared remote controller 300 for operating lighting fixture 100, the method including: receiving the radio command; receiving the infrared command; determining whether identification information of radio remote controller 200 is stored in storage 114 included in lighting fixture 100; if the identification information is stored in storage 114, among radio commands received, accepting a radio command that includes identification information same as the identification information stored in storage 114 and ignoring a radio command that includes identification information different from the identification information stored in storage 114, and ignoring the infrared command; and if no identification information is stored in storage 114, accepting the infrared command received.

According to the above configuration, in the lighting system which includes the plurality of lighting fixtures 100 and radio remote controller 200, both paired lighting fixture 100 and non-paired lighting fixture 100 are readily controllable. Specifically, lighting fixture 100 not paired with radio remote controller 200 is controllable by infrared remote controller 300.

Here, the method performed by lighting fixture 100 may further include, if the identification information of radio remote controller 200 is stored in storage 114 and an unpairing signal from infrared remote controller 300 is received, making the identification information of radio remote controller 200 stored in storage 114 unusable.

According to the above configuration, a desired lighting fixture 100 can be excluded from being controlled by radio remote controller 200. For example, to change lighting fixtures 100 which are controlled by radio remote controller 200 due to change of a room layout, a desired lighting fixture 100 can readily be unpaired by infrared remote controller 300. For example, lighting fixtures 100, which has unexpectedly been paired with radio remote controller 200 in the simple configuration mode, can readily be unpaired.

While the lighting fixture, the lighting system, and the method performed by lighting fixture according to the present disclosure have been described with reference to the embodiments, the present disclosure is not limited to the embodiments. Various modifications to embodiments that may be conceived by a person skilled in the art or other embodiments from any combinations of some of the components according to embodiments are intended to be included within the scope of the disclosure, without departing from the spirit of the present disclosure.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting device comprising:

a transceiver which receives radio commands for operating the lighting device, from a radio remote controller;

a receiver which receives an infrared command for operating the lighting device, from an infrared remote controller;

a storage for storing identification information of the radio remote controller serving as a master device; and a controller which determines whether the identification information is stored in the storage, wherein:

when the controller determines that the identification information is stored in the storage, the controller accepts a radio command that includes identification information same as the identification information stored in the storage, among the radio commands received by the transceiver, and discards the infrared command received by the receiver, and when the controller determines that no identification information is stored in the storage, the controller accepts the infrared command received by the receiver.

2. The lighting device according to claim 1, wherein the controller invalidates the identification information stored in the storage when the receiver receives an unpairing signal.

3. The lighting device according to claim 1, wherein the controller determines, immediately after the lighting device is powered on, whether the identification information of the radio remote controller serving as the master device is stored in the storage, causes the lighting device to enter a pairing configuration mode when the controller determines that the identification information of the radio remote controller serving as the master device is not stored in the storage, and in the pairing configuration mode, when the transceiver receives, from the radio remote controller, a pairing command which includes identification information and the receiver receives a pairing trigger signal from the infrared remote controller, stores the identification information included in the pairing command into the storage.

4. The lighting device according to claim 3, wherein the controller causes the lighting device to emit light in a first illumination mode when the controller determines that the identification information of the radio remote controller serving as the master device is not stored in the storage, causes the lighting device to emit light in a second illumination mode when the controller receives the pairing command in the pairing configuration mode, and causes the lighting device to emit light in a third illumination mode, after storing the identification information included in the pairing command into the storage.

5. A lighting system comprising:

lighting devices each being configured to function as the lighting device according to claim 1;

the radio remote controller configured to operate in a pairing configuration mode in which the radio remote controller transmits, repeatedly for a predetermined time period, a pairing command which includes identification information of the radio remote controller, and a normal operation mode in which the radio remote controller transmits the radio commands; and the infrared remote controller which transmits the infrared command to at least one of the lighting devices.

6. The lighting system according to claim 5, wherein the infrared remote controller emits, to a lighting device among the lighting devices, infrared light which has a distribution that does not concurrently reach a lighting device adjacent to the lighting device.

7. A method performed by a lighting device, the method comprising:

receiving radio commands for operating the lighting device, from a radio remote controller;

receiving an infrared command for operating the lighting device, from an infrared remote controller;

determining whether identification information of a radio remote controller serving as a master device is stored in a storage included in the lighting device;

when it is determined that the identification information is stored in the storage, accepting, among the radio commands, a radio command that includes the identification information stored in the storage, discarding, among the radio commands, a radio command that includes identification information different from the identification information stored in the storage, and discarding the infrared command; and when it is determined that the identification information of the radio remote controller serving as the master device is not stored in the storage, accepting the infrared command.

8. The method according to claim 7, further comprising when it is determined that the identification information of the radio remote controller serving as the master device is stored in the storage and an unpairing signal from the infrared remote controller is received, invalidating the identification information of the radio remote controller serving as the master device stored in the storage.

* * * * *